US007938067B2

(12) United States Patent
Dindl et al.

(10) Patent No.: US 7,938,067 B2
(45) Date of Patent: May 10, 2011

(54) REDUCED FIRING SIGNATURE WEAPON CARTRIDGE

(76) Inventors: Frank J Dindl, Newton, NJ (US); Kenneth R Jones, Wayne, NJ (US)

( * ) Notice: Subject to any disclaimer, the term of this patent is extended or adjusted under 35 U.S.C. 154(b) by 600 days.

(21) Appl. No.: 11/880,384

(22) Filed: Jul. 20, 2007

(65) Prior Publication Data

US 2011/0083575 A1 Apr. 14, 2011

(51) Int. Cl.
*F42B 5/26* (2006.01)

(52) U.S. Cl. ..... 102/464; 102/430; 102/514; 102/515; 102/516

(58) Field of Classification Search ..... 102/464, 102/430, 514–516
See application file for complete search history.

(56) References Cited

U.S. PATENT DOCUMENTS 3,127,836 A * 4/1964 Silva ..... 102/430
4,444,115 A * 4/1984 Romer et al. ..... 102/431
4,688,465 A * 8/1987 Melhus et al. ..... 86/20.14
5,359,937 A * 11/1994 Dittrich ..... 102/430
5,492,063 A * 2/1996 Dittrich ..... 102/430
5,677,505 A * 10/1997 Dittrich ..... 89/14.5
6,161,482 A * 12/2000 Clark ..... 102/532
6,253,682 B1 * 7/2001 Saxby ..... 102/444
6,439,123 B1 * 8/2002 Dionne et al. ..... 102/430
6,575,098 B2 * 6/2003 Hsiung ..... 102/498
6,799,518 B1 * 10/2004 Williams ..... 102/513
7,252,038 B2 * 8/2007 Olson et al. ..... 102/531
2009/0211482 A1 * 8/2009 Saxby ..... 102/430

* cited by examiner

*Primary Examiner* — Troy Chambers
*Assistant Examiner* — Samir Abdosh
(74) *Attorney, Agent, or Firm* — Townsend & Banta

(57) ABSTRACT

A reduced signature weapon cartridge is provided which, when fired, produces little or no muzzle blast or noise signature. In particular, a reduced signature weapon cartridge of the present invention comprises a movable piston disposed within the cartridge, disposed in between the high pressure chamber and the projectile. When fired, propellant gases rapidly force the piston forward within the cartridge case, thereby launching the projectile at a subsonic velocity, thereby eliminating the conventional noise signature associated with supersonic velocities. Thereafter, the propellant gases are slowly released from the cartridge case via perforations formed within the piston, grooves formed in the periphery of the piston, or via a gap between the piston and cartridge wall, thereby reducing or eliminating the conventional muzzle blast.

4 Claims, 4 Drawing Sheets

REDUCED FIRING SIGNATURE WEAPON CARTRIDGE

FIELD OF THE INVENTION

The present invention provides a weapon cartridge having reduced muzzle blast and noise signature. In particular, the present invention provides a reduced firing signature weapon cartridge having a movable, perforated piston disposed therein, which launches the projectile at a subsonic velocity, as well as slowly releasing propellant gas pressure from the weapon cartridge, so as to minimize muzzle blast and noise signature.

BACKGROUND OF THE INVENTION

When firing conventional weapon cartridges, the propellant charge within the cartridge is ignited, and the resultant propellant gas pressure propels (launches) the projectile from the cartridge. Generally, the propellant gas pressure is released with great force and high velocity, thereby causing a distinct and recognizable muzzle blast to be emitted from the weapon barrel. In addition, the rapid release of the high pressure propellant gases cause the projectile to be launched from the weapon barrel at a supersonic velocity, i.e., at a velocity greater than the speed of sound. A sonic boom is created upon reaching supersonic velocity, resulting in a distinctive noise signature.

Thus, firing of conventional weapon cartridges results in easily recognizable firing signatures, including muzzle blast and firing noise signature. In many situations, such as general combat, law enforcement, hunting, etc., such firing signatures are acceptable. However, in certain situations, these conventional firing signatures are undesirable and/or unacceptable. For example, special forces and sniper operations routinely require stealth and surprise. To maintain stealth and surprise, it is undesirable to create firing signatures, as they forecast to the enemy the location of the weapon.

Accordingly, it is an object of the present invention to provide a weapon cartridge having reduced or non-existent firing signatures upon firing, including reduced and/or eliminated muzzle blast and noise signature. In particular, it is an object of the present invention to provide a weapon cartridge that prevents rapid release of propellant gases from the cartridge upon firing (to minimize or eliminate identifiable muzzle blast), and is able to accurately fire the projectile at subsonic velocities (to minimize or reduce the noise signature created when the projectile reaches supersonic velocities).

SUMMARY OF THE INVENTION

In order to achieve the object of the present invention, as described above, the present inventor earnestly endeavored to develop a weapon cartridge capable of slowly releasing the propellant gases upon firing, and accurately fire the projectile thereof at subsonic velocities. Accordingly, in a first embodiment of the present invention, a reduced firing signature weapon cartridge comprising:

(a) a cartridge case having:

(i) a base, (ii) a hole disposed through said base defining a primer cavity, (iii) a hollow circumferential portion adjacent the base, said hollow portion having a first end contiguous with the base, and a second open end opposite the first end, and (iv) a high pressure chamber having a first end and a second end, said high pressure chamber disposed within the hollow circumferential portion, the first end of said high pressure chamber being disposed adjacent the primer cavity;

(b) a primer disposed within the primer cavity;

(c) a propellant charge disposed within the high pressure chamber;

(d) a piston having a first end and a second end movably disposed within the hollow circumferential portion adjacent the second end of the high pressure chamber, the first end of the piston disposed adjacent the second end of the high pressure chamber, said piston having one or more perforations disposed therethrough; and (e) a projectile having a first end and a second end, said projectile removably disposed within the hollow circumferential portion, the first end of said projectile in communication with the second end of the piston;

wherein, upon firing of the cartridge, propellant gases created by ignition of the propellant charge force the piston to accelerate forward within the hollow circumferential portion towards the open end of the hollow circumferential portion, thereby expelling the projectile from the cartridge, and releasing the propellant gases from the cartridge via the one or more perforations disposed through the piston.

In a second embodiment of the present invention, the reduced firing signature weapon cartridge of the first embodiment above is provided, wherein the piston has a diameter smaller than a diameter of the second open end of the hollow circumferential portion.

In a third embodiment of the present invention, the reduced firing signature weapon cartridge of the first embodiment above is provided, wherein the piston defines the second end of the high pressure chamber.

In a fourth embodiment of the present invention, the reduced firing signature weapon cartridge of the first embodiment above is provided, wherein the piston is comprised of rubber, plastic, aluminum, brass, steel, or a combination of two or more of same.

In a fifth embodiment of the present invention, the reduced firing signature weapon cartridge of the first embodiment above is provided, wherein the piston is disposed within the hollow circumferential portion at least ¼ or more of a length of the cartridge case from the second open end of the hollow circumferential portion.

In a sixth embodiment of the present invention, the reduced firing signature weapon cartridge of the first embodiment above is provided, wherein the projectile is not spin stabilized.

In a seventh embodiment of the present invention, the reduced firing signature weapon cartridge of the first embodiment above is provided, wherein the projectile is launched from the weapon cartridge at a subsonic velocity.

In an eighth embodiment of the present invention, the reduced firing signature weapon cartridge of the first embodiment above is provided, wherein said one or more perforations are comprised of grooves formed around a periphery of said piston.

In a ninth embodiment of the present invention, the reduced firing signature weapon cartridge of the first embodiment above is provided, wherein said one or more perforations are comprised of grooves formed around a periphery of said piston.

DETAILED DESCRIPTION OF THE INVENTION

Figure 1:
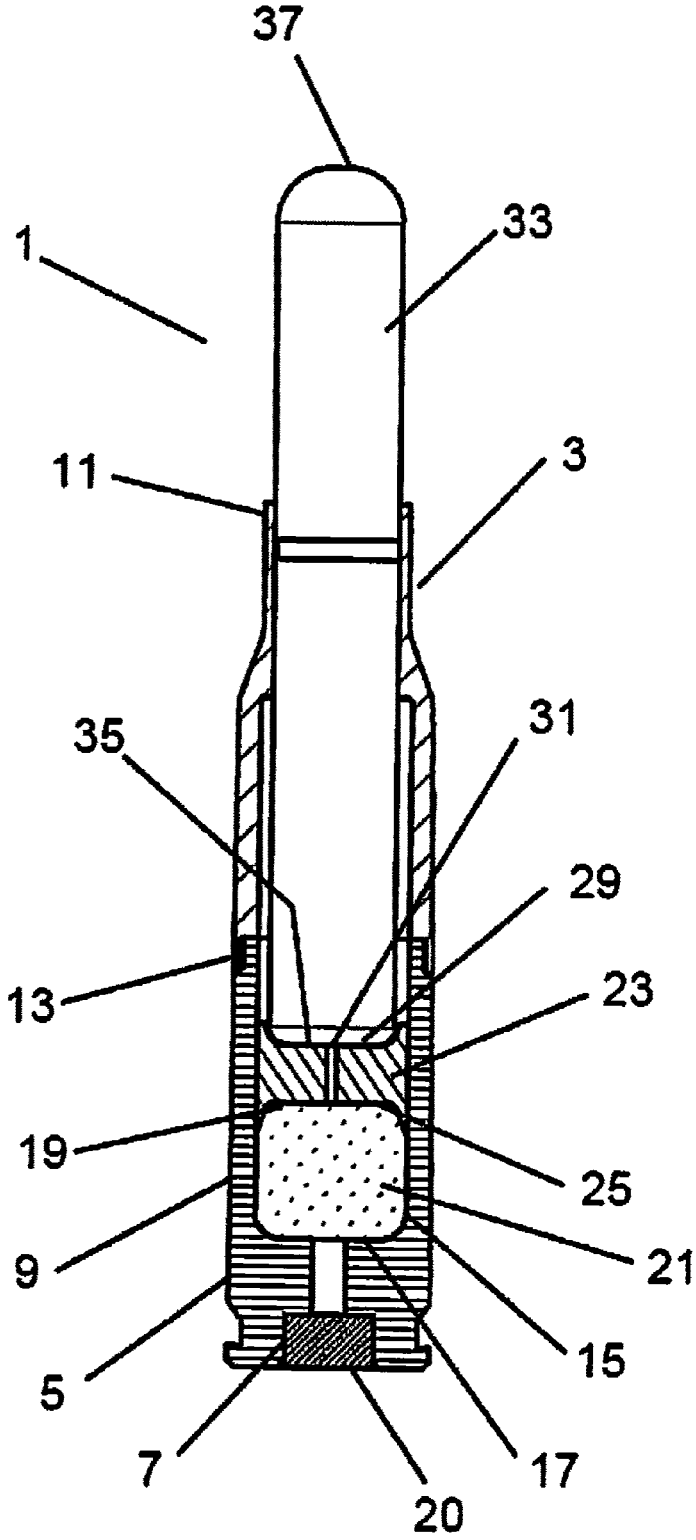
FIG. 1 is a cross sectional view of the reduced firing signature weapon cartridge of the present invention, illustrating the position of the piston before firing of the cartridge.
Figure 2:
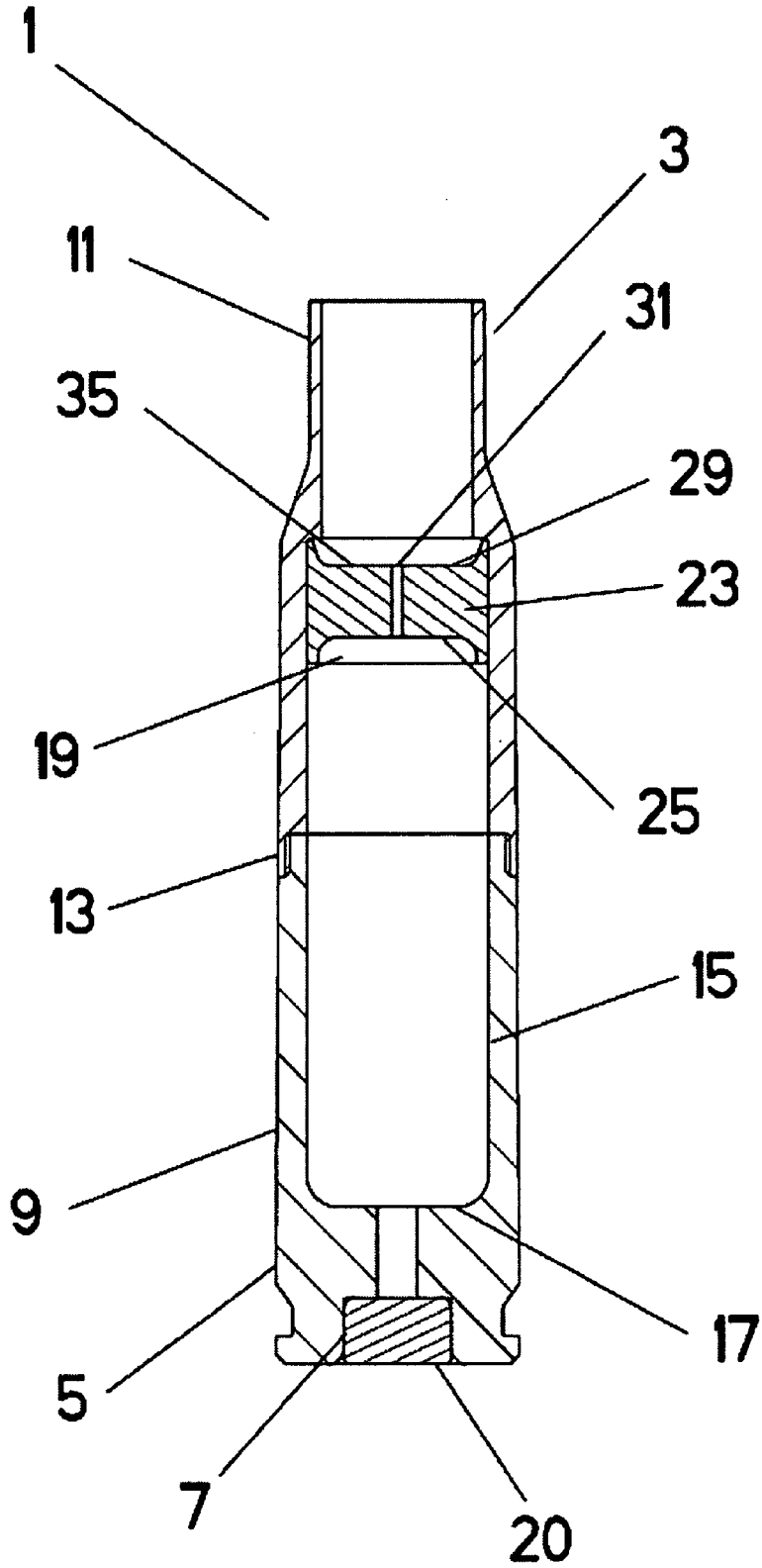
FIG. 2 is a cross sectional view of the reduced firing signature weapon cartridge of the present invention after firing, illustrating the position of the piston within the cartridge after the projectile has been launched therefrom.

As illustrated in FIG. 1, the reduced firing signature weapon cartridge 1 of the present invention is comprised of a cartridge case 3 having a base 5, a hole disposed through said base 5 defining a primer cavity 7, and a hollow circumferential portion 9 adjacent the base 5. The hollow circumferential portion 9 has a first end 11 contiguous with the base 5, and a second open end 13 opposite the first end 11.

A high pressure chamber 15, having a first end 17 and a second open end 19, is disposed within the hollow circumferential portion 9. The first end 17 of the high pressure chamber 15 is disposed adjacent the primer cavity 7. A primer 20 is disposed within the primer cavity 7, and a propellant charge 21 is disposed within the high pressure chamber 15.

A piston 23, having a first end 25 and a second end 29, is movably disposed within the hollow circumferential portion 9, adjacent the second end 19 of the high/low chamber 15. In particular, the first end 25 of the piston 23 is disposed adjacent the second end 29 of the high pressure chamber 15. The first end 25 of the piston 23 may define the second open end 19 of the high pressure chamber 15.

Figure 4:
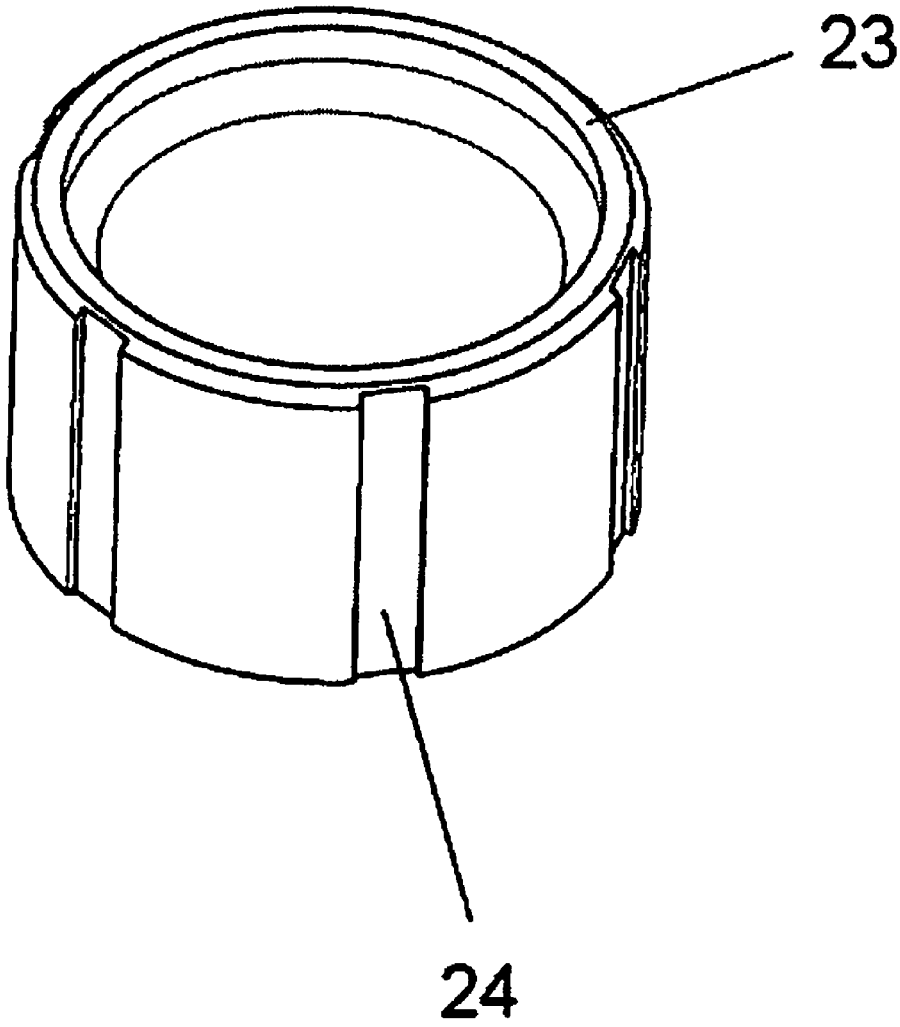
FIG. 4 is a perspective view of the piston of the present invention, illustrating the preferred embodiment wherein the piston has grooves formed along the periphery thereof so as to allow high pressure propellant gases to slowly leak out of the cartridge after firing.

Importantly, in a preferred embodiment, the piston 23 has one or more perforations 31 disposed therethrough. Alternatively, as illustrated in FIG. 4, the piston 23 may have grooves 24 formed around the periphery of the piston 23, or have a diameter smaller than the interior portion of the case (i.e., a gap between the cartridge and the case). These perforations 31, or alternatively the grooves N or gap mentioned above, allow high pressure propellant gases to slowly leak out of the cartridge after firing, so as to reduce or eliminate the muzzle blast created by rapid release of the propellant gases from the weapon muzzle. However, the perforations 31, as well as the grooves N or gap, are designed to allow the propellant gases to be released sufficiently fast enough to depressurize the cartridge prior to extraction of the cases from the weapon.

Figure 3:
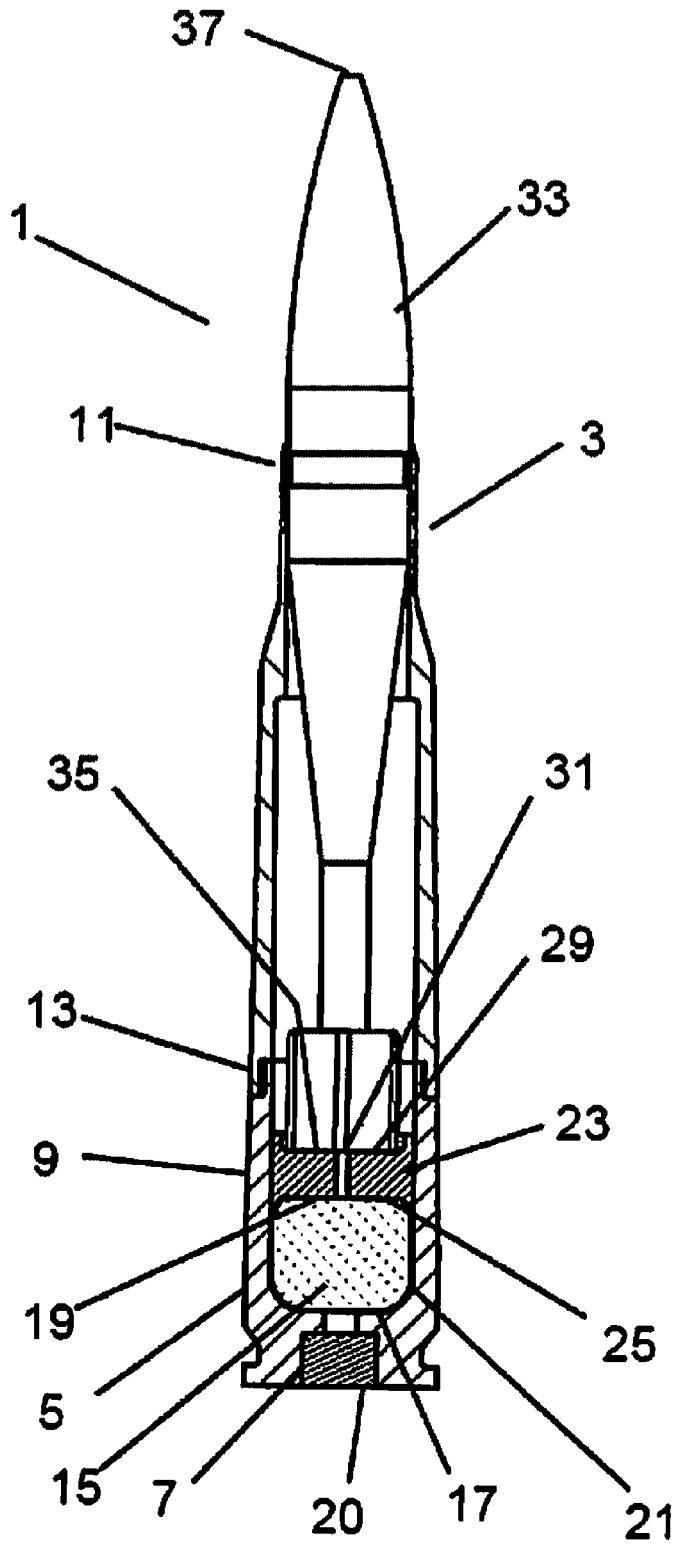
FIG. 3 is a cross sectional view of the reduced firing signature weapon cartridge of the present invention, illustrating the preferred embodiment of the invention having a fin-stabilized projectile.

A projectile 33, having a first end 35 and a second end 37, is provided, the projectile 33 being removably disposed within the hollow circumferential portion 9. Specifically, the first end 35 of the projectile is in communication with the second end 37 of the piston 23, and may be disposed through the second open end 13 of the hollow circumferential portion 9. The projectile 33 may be spin-stabilized, but is preferably fin-stabilized. Fin stabilized projectiles, as illustrated in FIG. 3, allow the use of long, heavy subsonic projectiles for maximum target affect and range.

Upon firing of the cartridge 1, propellant gases created by ignition of the propellant charge 21 force the piston 23 to accelerate forward within the hollow circumferential portion 9 towards the second open end 13 thereof. By doing so, the piston 23 strongly forces the projectile 31 forward, thereby launching the projectile 33 from the cartridge 1. However, the piston 23 prevents most of the propellant gases from acting directly upon the projectile 33, and the velocity of the piston 23 does not reach supersonic speeds. Thus, the projectile 33 is launched by the piston 23 from the cartridge 1 at subsonic velocities, thereby eliminating the recognizable noise signature created when firing conventional weapon cartridges.

After launching of the projectile 31 from the cartridge 1, pressurized propellant gases are released from the cartridge 1 in a controlled manner via the perforations 31 disposed through the piston 23. This slow release of propellant gases reduces or eliminates the recognizable muzzle flash associated with rapid release of propellant gases from the weapon barrel.

The piston 23 may be formed of any suitable material capable of withstanding the high temperatures and pressure associated with the firing event. In particular, the piston is preferably formed of a rubber and/or other material capable of easily sliding within the hollow circumferential portion 9, yet providing a good gas seal against the interior wall of the hollow circumferential portion 9. To be able to do so, the piston 23 must have a diameter slightly smaller than the interior wall of the hollow circumferential portion. Further, to prevent the piston 23 from being expelled from the cartridge 1 by the propellant gases upon firing, the diameter of the piston is preferably smaller than the diameter of the second open end 13 of the hollow circumferential portion 9.

As mentioned above, it is important that the piston 23 provide a fairly tight seal against the interior of the hollow circumferential portion 9, so that when the cartridge 1 is fired, the resulting propellant gases cannot leak around the piston. If this was allowed to occur, the piston would not be propelled forward at a sufficient force to properly launch the projectile, and the propellant gases would be rapidly released from the cartridge, creating an undesirable muzzle flash.

Further, in order to have sufficient force to launch the projectile from the cartridge at an acceptable velocity, the piston 23 must be able to travel a minimum distance (piston travel distance) within the hollow circumferential portion 9 after firing of the cartridge 1. This piston travel distance is dependent upon many variable factors, such as cartridge size, projectile mass, desired projectile velocity, etc. Generally, the piston 23 is disposed within the hollow circumferential portion 9 at least ¼ or more of the length of the cartridge case 9, from the second open end 13 of the hollow circumferential portion 9. However, as described above, the distance may be greatly altered depending upon various variable factors.

Although specific embodiments of the present invention have been disclosed herein, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

What is claimed is:

1. A non-telescoping reduced firing signature weapon cartridge comprising:

(a) a cartridge case having:

(i) a base, (ii) a hole disposed through said base defining a primer cavity, (iii) a hollow circumferential portion adjacent the base, said hollow portion having a first end contiguous with the base, and a second open end opposite the first end, and (iv) a high pressure chamber having a first end and a second end, said high pressure chamber disposed within the hollow circumferential portion, the first end of said high pressure chamber being disposed adjacent the primer cavity;

(b) a primer disposed within the primer cavity;

(c) a propellant charge disposed within the high pressure chamber;

(d) a piston having a first end and a second end movably disposed within the hollow circumferential portion of the cartridge case adjacent the second end of the high pressure chamber, and at least ¼ or more of a length of the cartridge case from the second open end of the hollow circumferential portion, the first end of the piston disposed adjacent the second end of the high pressure chamber, said piston having one or more perforations disposed therethrough; and (e) a subsonic fin-stabilized projectile having a first end and a second end, said fin-stabilized projectile removably disposed within the hollow circumferential portion, the first end of said projectile in communication with the second end of the piston;

wherein, upon firing of the cartridge, propellant gases created by ignition of the propellant charge force the piston to accelerate forward within the hollow circumferential portion towards the open end of the hollow circumferential portion, thereby expelling the projectile from the cartridge and propelling same at a subsonic velocity, and are then controllably released releasing from the cartridge via the one or more perforations disposed through said piston so as to reduce or eliminate muzzle flash and sound.

2. The non-telescoping reduced signature weapon cartridge of claim 1, wherein the piston has a diameter smaller than a diameter of the second open end of the hollow circumferential portion.

3. The non-telescoping reduced signature weapon cartridge of claim 1, wherein the piston defines the second end of the high pressure chamber.

4. The non-telescoping reduced firing signature weapon cartridge of claim 1, wherein said one or more perforations are comprised of grooves formed around a periphery of said piston.

* * * * *